US009014394B2

(12) United States Patent
Cohen et al.

(10) Patent No.: US 9,014,394 B2
(45) Date of Patent: Apr. 21, 2015

(54) SYSTEMS AND METHODS FOR RETAINING A MICROPHONE

(75) Inventors: Sawyer Cohen, Cupertino, CA (US); Michael Wittenberg, Sunnyvale, CA (US); David Pakula, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 322 days.

(21) Appl. No.: 13/607,491

(22) Filed: Sep. 7, 2012

(65) Prior Publication Data

US 2014/0072141 A1 Mar. 13, 2014

(51) Int. Cl.

| | |
|---|---|
| ***H04R 1/02*** | (2006.01) |
| ***H04R 13/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/04*** | (2006.01) |

(52) U.S. Cl.

CPC ..... *H04R 1/04* (2013.01)

(58) Field of Classification Search

None

See application file for complete search history.

(56) References Cited

U.S. PATENT DOCUMENTS

| | | | | |
|---|---|---|---|---|
| 8,229,153 | B2 * | 7/2012 | Mittleman et al. | 381/361 |
| 2013/0108082 | A1 * | 5/2013 | Dave et al. | 381/122 |

* cited by examiner

*Primary Examiner* — Regina N Holder

(74) *Attorney, Agent, or Firm* — Brownstein Hyatt Farber Schreck, LLP

(57) ABSTRACT

Systems and methods for retaining a microphone using a microphone boot are disclosed. The microphone boot may include a sound channeling structure for receiving and delivering sound, and a microphone retaining block for retaining a microphone and passing the sound to the microphone. The sound channeling structure may be secured to a housing of an electronic device. The sound channeling structure may include a sound tube and a hooking component that may be insertable into a tunnel and a slot, respectively, of the microphone retaining block. The sound tube may deliver the sound into the tunnel for passing to the microphone. The hooking component may lock into the slot to secure the sound channeling structure to the microphone retaining block. Thus, the microphone boot may be tightly sealed to prevent leakage of the sound, and may fix the microphone within the electronic device even in the presence of external force.

26 Claims, 12 Drawing Sheets

SYSTEMS AND METHODS FOR RETAINING A MICROPHONE

FIELD OF THE INVENTION

This can relate to systems and methods for retaining a microphone, and more particularly, to systems and methods for retaining a microphone using a microphone boot.

BACKGROUND OF THE DISCLOSURE

Oftentimes during usage, an electronic device may be subjected to deliberate external forces (e.g., improper handling of the electronic device). These deliberate forces may transfer vibrations to various components housed in the electronic device, and may cause these various components to move within the electronic device. For example, the deliberate forces may transfer vibrations to a microphone of the electronic device. In particular, these vibrations may mechanically couple into the microphone, which may cause undesirable sounds to be input into an audio system of the electronic device. When the electronic device is subjected to such deliberate forces continuously over time, the performance of the microphone may be affected.

In addition, because a microphone is typically best suited to receive sound from a single sound path, it may be desirable to ensure that substantially all of the sound received by an electronic device (e.g., via a housing aperture) is relayed to the microphone (e.g., to a diaphragm of the microphone) via a single sound path. As an example, oftentimes in conventional microphone systems, multiple sound paths may exist between the outside of the electronic device and the microphone. When this occurs, sound entering the electronic device via these multiple paths may interfere with each other, causing constructive and destructive interference of sound waves. This creates high and low peaks in the frequency response of the microphone, which may prevent the microphone from accurately detecting the incoming sound. As another example, if the electronic device includes a speaker housed within, sound exiting or radiating from the speaker's walls may be picked up by the microphone. This can cause an undesirable echo when the electronic device is used in speakerphone mode, for example.

SUMMARY OF THE DISCLOSURE

Systems and methods for retaining a microphone using a microphone boot are provided.

In some embodiments, a microphone boot may be provided. The microphone boot may include a sound channeling structure including a frame, a sound tube, and at least one hooking component. The sound tube and the at least one hooking component may extend away from a first side of the frame. The microphone boot may also include a microphone retaining block including a front face, a microphone retaining cavity, a tunnel, and at least one slot. The tunnel may extend from the front face to the microphone retaining cavity. The tunnel may be operative to receive the sound tube and each slot of the at least one slot may be operative to releasably couple a respective one of the at least one hooking component when the sound channeling structure is coupled to the microphone retaining block.

In some embodiments, an electronic device may be provided. The electronic device may include a housing having a housing aperture, a microphone having a microphone aperture, and a microphone boot having a first boot structure and a second boot structure releasably coupled to each other. The first boot structure may include a sound delivering channel having an opening at each end. A first one of the openings may be aligned with the housing aperture and a second one of the openings may be disposed in the second boot structure. The microphone may resides within the second boot structure. The microphone aperture may be aligned with the second one of the openings.

In some embodiments, a method of integrating a sound channeling structure with a microphone retaining block to form a microphone boot may be provided. The sound channeling structure may include a frame having a sound tube and a hooking component disposed thereon. The microphone retaining block may include a tunnel and a slot. The method may include mating the sound tube with the tunnel, and releasably coupling the hooking component to the slot to form the microphone boot.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Systems and methods for retaining a microphone using a microphone boot are provided and described with reference to FIGS. 1-7.

Figure 1A:
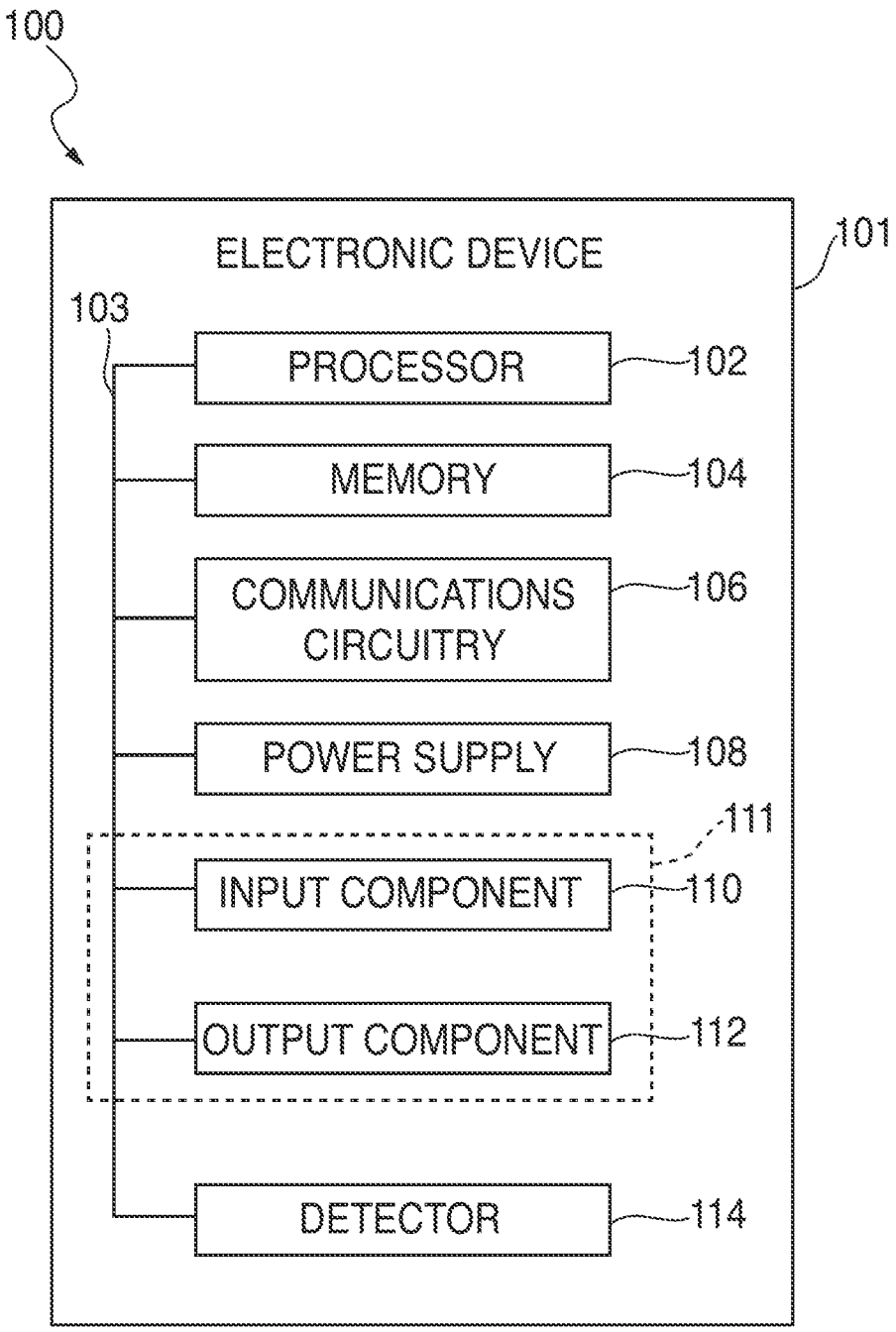
FIG. 1A is a schematic view of an illustrative electronic device, in accordance with at least one embodiment.

FIG. 1A is a schematic view of an illustrative electronic device 100. In some embodiments, electronic device 100 may perform a single function (e.g., a device dedicated to storing image content) and, in other embodiments, electronic device 100 may perform multiple functions (e.g., a device that stores image content, plays music, and receives and transmits telephone calls). Moreover, in some embodiments, electronic device 100 may be any portable, mobile, or hand-held electronic device configured to control output of content. Alternatively, electronic device 100 may not be portable at all, but may instead be generally stationary. Electronic device 100 may include any suitable type of electronic device operative to control output of content. For example, electronic device 100 may include a media player (e.g., an iPod™ available by Apple Inc. of Cupertino, Calif.), a cellular telephone (e.g., an iPhone™ available by Apple Inc.), a personal e-mail or messaging device (e.g., a Blackberry™ available by Research In Motion Limited of Waterloo, Ontario), any other wireless communication device, a pocket-sized personal computer, a personal digital assistant ("PDA"), a tablet, a laptop computer, a desktop computer, a music recorder, a still camera, a movie or video camera or recorder, a radio, medical equipment, any other suitable type of electronic device, and any combinations thereof.

Electronic device 100 may include a processor or control circuitry 102, memory 104, communications circuitry 106, power supply 108, input component 110, output component 112, and a detector 114. Electronic device 100 may also include a bus 103 that may provide a transfer path for transferring data and/or power, to, from, or between various other components of device 100. In some embodiments, one or more components of electronic device 100 may be combined or omitted. Moreover, electronic device 100 may include other components not combined or included in FIG. 1A. For example, electronic device 100 may include motion detection circuitry, light sensing circuitry, positioning circuitry, or several instances of the components shown in FIG. 1A. For the sake of simplicity, only one of each of the components is shown in FIG. 1A.

Memory 104 may include one or more storage mediums, including for example, a hard-drive, flash memory, permanent memory such as read-only memory ("ROM"), semi-permanent memory such as random access memory ("RAM"), any other suitable type of storage component, or any combination thereof. Memory 104 may include cache memory, which may be one or more different types of memory used for temporarily storing data for electronic device applications. Memory 104 may store media data (e.g., music, image, and video files), software (e.g., for implementing functions on device 100), firmware, preference information (e.g., media playback preferences), lifestyle information (e.g., food preferences), exercise information (e.g., information obtained by exercise monitoring equipment), transaction information (e.g., information such as credit card information), wireless connection information (e.g., information that may enable device 100 to establish a wireless connection), subscription information (e.g., information that keeps track of podcasts or television shows or other media a user subscribes to), contact information (e.g., telephone numbers and e-mail addresses), calendar information, any other suitable data, or any combination thereof.

Communications circuitry 106 may be provided to allow device 100 to communicate with one or more other electronic devices or servers using any suitable communications protocol. For example, communications circuitry 106 may support Wi-Fi (e.g., an 802.11 protocol), Ethernet, Bluetooth™, high frequency systems (e.g., 900 MHz, 2.4 GHz, and 5.6 GHz communication systems), infrared, transmission control protocol/internet protocol ("TCP/IP") (e.g., any of the protocols used in each of the TCP/IP layers), hypertext transfer protocol ("HTTP"), BitTorrent™, file transfer protocol ("FTP"), real-time transport protocol ("RTP"), real-time streaming protocol ("RTSP"), secure shell protocol ("SSH"), any other communications protocol, or any combination thereof. Communications circuitry 106 may also include circuitry that can enable device 100 to be electrically coupled to another device (e.g., a computer or an accessory device) and communicate with that other device, either wirelessly or via a wired connection.

Power supply 108 may provide power to one or more of the other components of device 100. In some embodiments, power supply 108 can be coupled to a power grid (e.g., when device 100 is not a portable device, such as a desktop computer). In some embodiments, power supply 108 can include one or more batteries for providing power (e.g., when device 100 is a portable device, such as a cellular telephone). As another example, power supply 108 can be configured to generate power from a natural source (e.g., solar power using solar cells).

One or more input components 110 may be provided to permit a user to interact or interface with device 100. For example, input component 110 can take a variety of forms, including, but not limited to, an electronic device pad, dial, click wheel, scroll wheel, touch screen, one or more buttons (e.g., a keyboard), mouse, joy stick, track ball, a microphone, and combinations thereof. For example, input component 110 may include a multi-touch screen. Each input component 110 can be configured to provide one or more dedicated control functions for making selections or issuing commands associated with operating device 100.

Electronic device 100 may also include one or more output components 112 that may present information (e.g., textual, graphical, audible, and/or tactile information) to a user of device 100. Output component 112 of electronic device 100 may take various forms, including, but not limited, to audio speakers, in-ear earphones, headphones, audio line-outs, visual displays, antennas, infrared ports, rumblers, vibrators, or combinations thereof.

For example, output component 112 of electronic device 100 may include an image display 112 as an output component. Such an output component display 112 may include any suitable type of display or interface for viewing image data captured by detector 114. In some embodiments, display 112 may include a display embedded in device 100 or coupled to device 100 (e.g., a removable display). Display 112 may include, for example, a liquid crystal display ("LCD"), a light emitting diode ("LED") display, an organic light-emitting diode ("OLED") display, a surface-conduction electron-emitter display ("SED"), a carbon nanotube display, a nanocrystal display, any other suitable type of display, or combination thereof. Alternatively, display 112 can include a movable display or a projecting system for providing a display of content on a surface remote from electronic device 100, such as, for example, a video projector, a head-up display, or a three-dimensional (e.g., holographic) display.

In some embodiments, output component 112 may include an audio output module that may be coupled to an audio connector (e.g., a male audio jack) for interfacing with an audio device (e.g., a headphone, an in-ear earphone, a microphone, etc.).

It should be noted that one or more input components 110 and one or more output components 112 may sometimes be referred to collectively herein as an I/O interface (e.g., input component 110 and output component 112 as I/O interface 111). It should also be noted that input component 110 and output component 112 may sometimes be a single I/O component, such as a touch screen that may receive input information through a user's touch of a display screen and that may also provide visual information to a user via that same display screen.

Detector 114 may include one or more sensors of any suitable type that may capture human recognition data (e.g., face data) that may be utilized to detect the presence of one or more individuals. For example, detector 114 may include an image sensor and/or an infrared sensor. The image sensor may include one or more cameras with any suitable lens or number of lenses that may be operative to capture images of the surrounding environment of electronic device 100. For example, the image sensor may include any number of optical or digital lenses for capturing light reflected by the device's environment as an image. The captured light may be stored as an individual distinct image or as consecutive video frame images of a recording (e.g., several video frames including a primary frame and one or more subsequent frames that may indicate the difference between the primary frame and the subsequent frame). As used herein, the term "camera lens" may be understood to mean a lens for capturing light or a lens and appropriate circuitry for capturing and converting captured light into an image that can be analyzed or stored by electronic device 100 as either an individual distinct image or as one of many consecutive video frame images.

In some embodiments, detector 114 may also include one or more sensors that may detect any human feature or characteristic (e.g., physiological, psychological, physical, movement, etc.). For example, detector 114 may include a microphone for detecting voice signals from one or more individuals. As another example, detector 114 may include a heartbeat sensor for detecting heartbeats of one or more individuals. As yet other examples, detector 114 may include a fingerprint reader, an iris scanner, a retina scanner, a breath sampler, and a humidity sensor that may detect moisture and/or sweat emanating from any suitable portion of an individual's body. For example, detector 114 may include a humidity sensor that may be situated near or coupled to one or more portions of input component 110, and that may detect moisture and/or sweat from an individual's hands. It should be appreciated that any detector 114 may include any sensor that may detect any human feature or characteristic.

In some embodiments, detector 114 may also include positioning circuitry for determining a current position of device 100. The positioning circuitry may be operative to update the current position at any suitable rate, including at relatively high rates to provide an estimation of speed and distance traveled. In some embodiments, the positioning circuitry may include a global positioning system ("GPS") receiver for accessing a GPS application function call that may return geographic coordinates (i.e., a geographic location) of the device. The geographic coordinates may be fundamentally, alternatively, or additionally, derived from any suitable trilateration or triangulation technique. For example, the positioning circuitry may determine the current location of device 100 by using various measurements (e.g., signal-to-noise ratio ("SNR") or signal strength) of a network signal (e.g., a cellular telephone network signal) that may be associated with device 100. For example, a radio frequency ("RF") triangulation detector or sensor integrated with or connected to device 100 may determine the (e.g., approximate) current location of device 100. Device 100's current location may be determined based on various measurements of device 100's own network signal, such as, for example: (1) an angle of the signal's approach to or from one or more cellular towers, (2) an amount of time for the signal to reach one or more cellular towers or device 100, (3) the strength of the signal when it reaches one or more towers or device 100, or any combination of the aforementioned measurements. Other forms of wireless-assisted GPS (e.g., enhanced GPS or A-GPS) may also be used to determine the current position of device 100. Instead or in addition, the positioning circuitry may determine the current location of device 100 based on a wireless network or access point that may be in range or a wireless network or access point to which device 100 may be currently connected. For example, because wireless networks may have a finite range, a wireless network that may be in range of device 100 may indicate that device 100 is located in within a detectable vicinity of the wireless network. In some embodiments, device 100 may automatically connect to a wireless network that may be in range in order to receive valid modes of operation that may be associated or that may be available at the current position of device 100.

In some embodiments, detector 114 may also include motion sensing circuitry for detecting motion of an environment of device 100 and/or objects in the environment. For example, the motion sensing circuitry may detect a movement of an object (e.g., an individual) about device 100 and may generate one or more signals based on the detection.

Processor 102 of device 100 may control the operation of many functions and other circuitry provided by device 100. For example, processor 102 may receive input signals from input component 110 and/or drive output signals through display 112. Processor 102 may load a manager program (e.g., a program stored in memory 104 or another device or server accessible by device 100) to process or analyze data received via detector 114 or inputs received via input component 110 to control output of content that may be provided to the user via output component 112 (e.g., display 112). Processor 102 may associate different metadata with the human recognition data captured by detector 114, including, for example, positioning information, device movement information, a time code, a device identifier, or any other suitable metadata. Electronic device 100 (e.g., processor 102, any circuitry of detector 114, or any other component available to device 100) may be configured to capture data with detector 114 at various resolutions, frequencies, intensities, and various other characteristics as may be appropriate for the capabilities and resources of device 100.

Electronic device 100 may also be provided with a housing 101 that may at least partially enclose one or more of the components of device 100 for protecting them from debris and other degrading forces external to device 100. In some embodiments, one or more of the components may be provided within its own housing (e.g., input component 110 may be an independent keyboard or mouse within its own housing that may wirelessly or through a wire communicate with processor 102, which may be provided within its own housing).

Electronic device 100 may include one or more microphones (e.g., as part of I/O interface 111) for capturing sounds from the environment (e.g., a user's voice). It should be appreciated that various criteria may be used to select the type of microphone for inclusion in an electronic device. For example, it may be preferable to use microphones that draw minimal power, that are compact, and that are easy to manufacture and integrate into electronic devices. As another example, it may be important to choose a microphone that provides a suitable frequency response. For example, a microphone may have a suitable frequency response if it can receive sounds over a range of frequencies that are audible to humans. MEMS microphones can provide one or more of these features. For example, MEMS microphones are smaller than conventional counterparts, and may allow an electronic device to be made smaller. MEMS microphones are also easy to integrate into electronic devices and can provide suitable frequency responses.

Figure 1B:
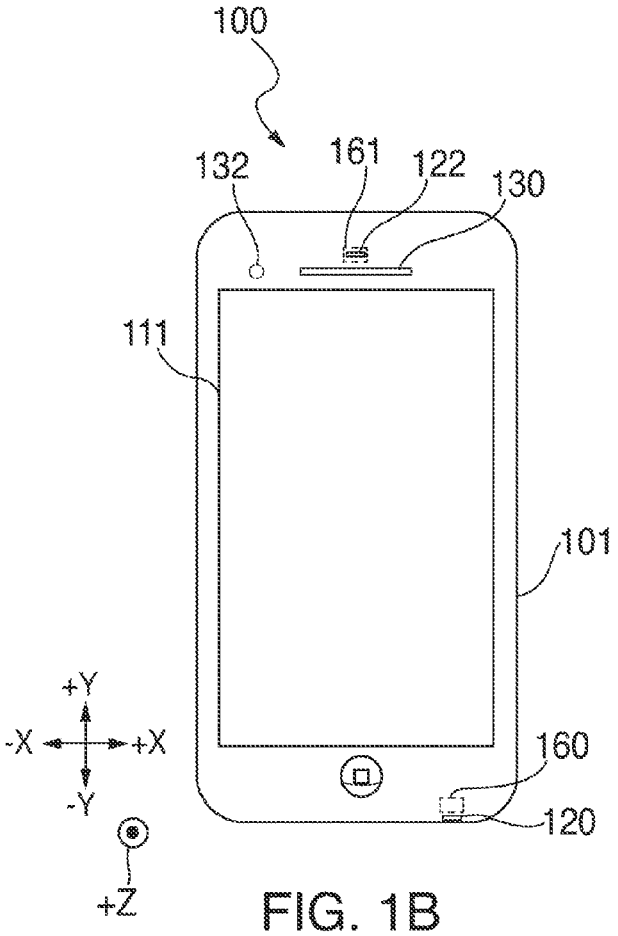
FIG. 1B is a front view of the electronic device of FIG. 1A, in accordance with at least one embodiment.

FIG. 1B is a front view of electronic device 100. As shown in FIG. 1B, housing 101 may at least partially enclose I/O interface 111. Moreover, housing 101 may include a microphone 160 (e.g., a MEMS microphone) and an aperture 120 through a portion of housing 101 (e.g., cut through a glass portion of housing 101). Aperture 120 may be situated on a bottom surface of electronic device 100 and may face the –Y direction. Microphone 160 may be situated within housing 101 and adjacent aperture 120 such that, when a user holds electronic device 100 close to the user's face, sound from the user's mouth may pass through aperture 120 and travel towards microphone 160.

Although typical electronic devices may only include a single microphone, electronic device 100 may include a plurality of microphones. For example, electronic device 100 may include an aperture 122 through another portion of housing 101 (e.g., cut through another glass portion of housing 101) and may, in addition to microphone 160, include a microphone 161 (e.g., another MEMS microphone). Aperture 122 may be situated on a front surface of housing 101 (e.g., adjacent a receiver 130 that may be a component of detector 114) and may face the +Z direction (e.g., out of the page shown in FIG. 1B). Microphone 161 may be situated within housing 101 and adjacent aperture 122 such that, when a user holds electronic device 100 with the front surface facing the user (e.g., during a video conference using a camera 132 of electronic device 100), sound from the user's mouth may pass through aperture 122 and travel towards microphone 161. Situating microphone 161 on the front surface of housing 101 may more efficiently capture sound during such a video conference call, since the sound from the user's mouth may not be sufficiently directed towards the bottom surface of housing 101 for microphone 160 to capture.

Figure 1C:
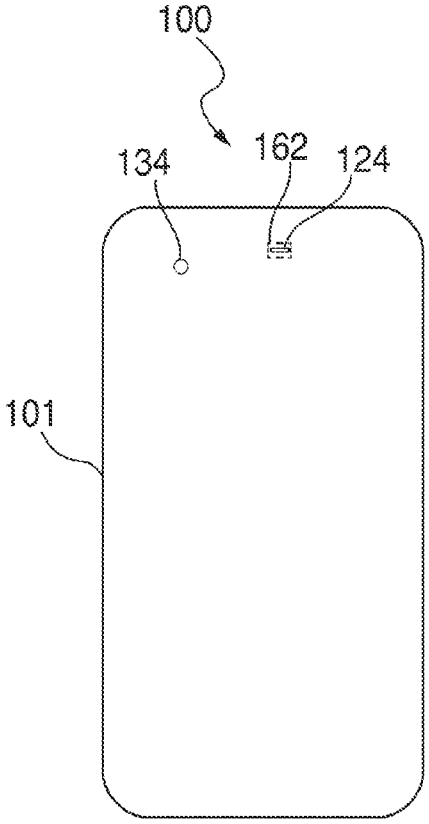
FIG. 1C is a back view of the electronic device of FIG. 1A, in accordance with at least one embodiment.

FIG. 1C is a back view of electronic device 100. As shown in FIG. 1C, electronic device 100 may include an aperture 124 through another portion of housing 101 (e.g., cut through yet another glass portion of housing 101) and may, in addition to microphones 160 and 161, include a microphone 162 (e.g., yet another MEMS microphone). Aperture 124 may be situated on a back surface of housing 101 (e.g., near a top portion of the back surface) and may face a direction opposite the +Z direction of FIG. 1B. Microphone 162 may be situated within housing 101 and adjacent aperture 124 such that, when a user holds electronic device 100 with the back surface facing the user (e.g., during a video conference using a camera 134 of electronic device 100), sound from the user's mouth may pass through aperture 124 and travel towards microphone 162. Situating microphone 162 on the back surface of housing 101 may allow more efficient capture of sound during such a video conference call, since the sound from the user's mouth may not be sufficiently directed towards the front or bottom surfaces of housing 101 for any of microphones 160 and 161 to capture.

Oftentimes during usage, an electronic device may be subjected to deliberate external forces (e.g., improper handling of the electronic device). These deliberate forces may transfer vibrations to various components housed in the electronic device, and may cause these various components to move within the electronic device. For example, the deliberate forces may transfer vibrations to a microphone of the electronic device. In particular, these vibrations may mechanically couple into the microphone, which may cause undesirable sounds to be input into an audio system of the electronic device. When the electronic device is subjected to such deliberate forces continuously over time, the performance of the microphone may be affected.

In addition, because a microphone is typically best suited to receive sound from a single sound path, it may be desirable to ensure that substantially all of the sound received by an electronic device (e.g., via a housing aperture) is relayed to the microphone (e.g., to a diaphragm of the microphone) via a single sound path. As an example, oftentimes in conventional microphone systems, multiple sound paths may exist between the outside of the electronic device and the microphone. When this occurs, sound entering the electronic device via these multiple paths may interfere with each other, causing constructive and destructive interference of sound waves. This creates high and low peaks in the frequency response of the microphone, which may prevent the microphone from accurately detecting the incoming sound. As another example, if the electronic device includes a speaker housed within, sound exiting or radiating from the speaker's walls may be picked up by the microphone. This can cause an undesirable echo when the electronic device is used in speakerphone mode, for example.

Figure 2A:
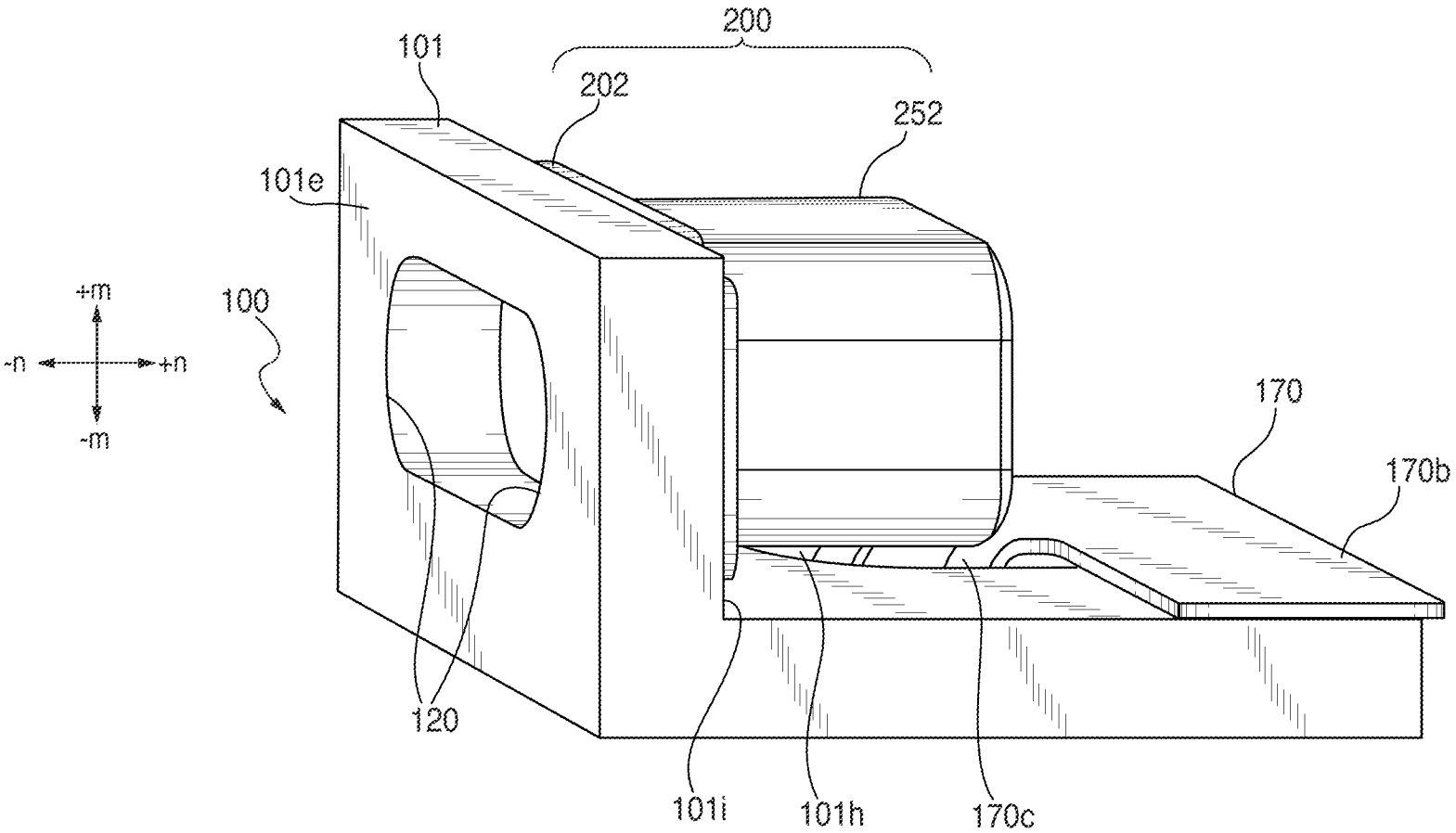
FIG. 2A shows a view of a portion of the electronic device of FIG. 1A, including a microphone boot, from a first perspective, in accordance with at least one embodiment.
Figure 2B:
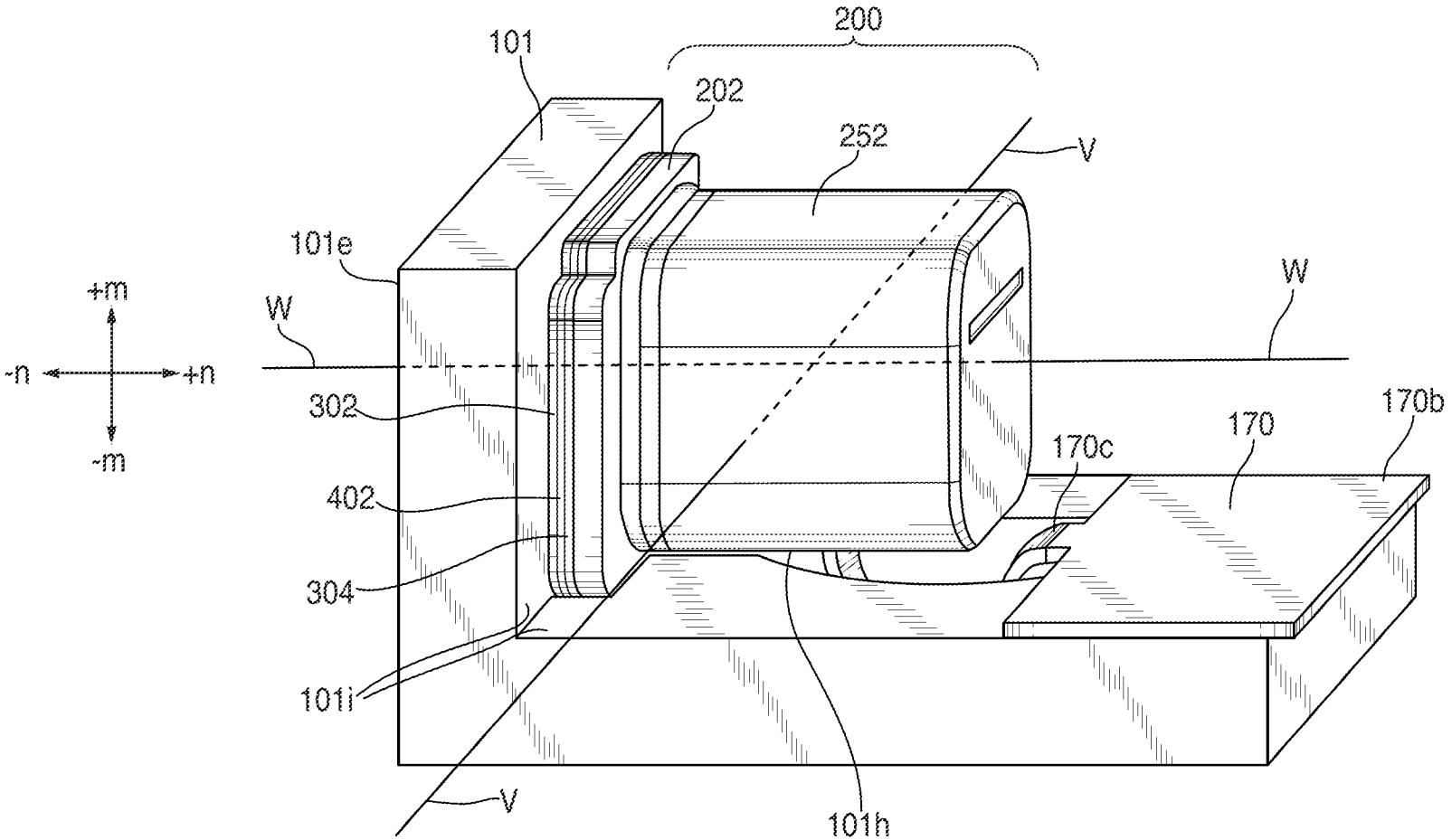
FIG. 2B shows a view of the portion of electronic device of FIG. 1A, including the microphone boot of FIG. 2A, from a second perspective, in accordance with at least one embodiment.

FIG. 2A shows a view of a portion of electronic device 100, including a microphone boot 200, from a first perspective. FIG. 2B shows a view of the portion of electronic device 100, including microphone boot 200, from a second perspective. As described below, microphone boot 200 may be configured to channel sound received by electronic device 100 to microphone 160 with minimal sound leakage, and protect microphone 160 from movement within electronic device 100 even when electronic device 100 is subjected to external force.

As shown in FIGS. 2A and 2B, microphone boot 200 may include a sound channeling structure 202 and a microphone retaining block 252. Sound channeling structure 202 may be configured to receive sound (e.g., that may pass through housing aperture 120 in a +n direction, as shown in FIG. 2B) and deliver the received sound to microphone retaining block 252. Sound channeling structure 202 may also couple to microphone retaining block 252 such that there is minimal to no leakage of air between coupling faces of sound channeling structure 202 and microphone retaining block 252. For example, sound channeling structure 202 may couple to microphone retaining block 252 in a relatively tight seal. Microphone retaining block 252 may include a retaining cavity (described later) that may be configured to retain microphone 160, for example. A tight seal between sound channeling structure 202 and microphone retaining block 252 may allow sound channeling structure 202 to deliver substantially all of the received sound to microphone retaining block 252 (and thus, to microphone 160).

Each of sound channeling structure 202 and microphone retaining block 252 may be composed of any suitable material. In some embodiments, microphone retaining block 252 may be softer or more compliant than sound channeling structure 202. For example, sound channeling structure 202 may be composed of metal, whereas microphone retaining block 252 may be composed of any material that may be softer than metal (e.g., durometer 50 silicone). As described below, a softer (or more compliant) microphone retaining block 252 may at least partially expand (e.g., internally) when portions of sound channeling structure 202 are inserted into corresponding portions of microphone retaining block 252.

As shown in FIG. 2B, sound channeling structure 202 may couple to internal surface side 101*i*. This may secure sound channeling 202 (and thus, the entirety of microphone boot 200) within electronic device 100. In this manner, microphone 160 may be fixed within electronic device 100 and isolated or protected from undesired movement that may be caused from, for example, forceful contact of electronic device with an external object.

Sound channeling structure 202 may couple to internal surface side 101*i* via one or more adhesives. In particular, sound channeling structure 202 may directly couple to an adhesive 304, which may, in turn, couple to a cosmetic mesh 402. Cosmetic mesh 402 may include any filter that may block external contaminants (e.g., water, dirt, dust, etc.) from entering microphone boot 200. Cosmetic mesh 402 may directly couple to an adhesive 302, which may, in turn, couple to internal surface side 101*i*. Adhesive 302 may be similar to adhesive 304, and may be composed of any suitable material (e.g., acrylic PSA, silicone, etc.) that may adhere to various surface types (e.g., the surfaces of cosmetic mesh 402, internal surface side 101*i*, and sound channeling structure 202).

As described above, microphone 160 may reside within a retaining cavity of microphone retaining block 22. Because microphone 160 may also be mounted on a portion (not shown in FIGS. 2A and 2B) of a circuit board 170 (e.g., a flex or flexible printed circuit board ("PCB")), the retaining cavity may be configured to also retain that portion of circuit board 170. This portion of circuit board 170 may couple to portion 170*b*, which may reside on internal surface side 101*i*. The portion of circuit board 170 and portion 170*b* may couple to each other via a connection 170*c* that may be configured to bend and at least partially reside within a hole 101*h* of internal surface side 101*i*. Connection 170*c* may be configured to bend in this manner based on spacing requirements within electronic device 100. For example, by positioning connection 170*c* at least partially within hole 101*h*, microphone boot 200 may be positioned closer to internal surface side 101*i* (e.g., in the −m direction), allowing electronic device 100 to be made smaller.

Figure 3A:
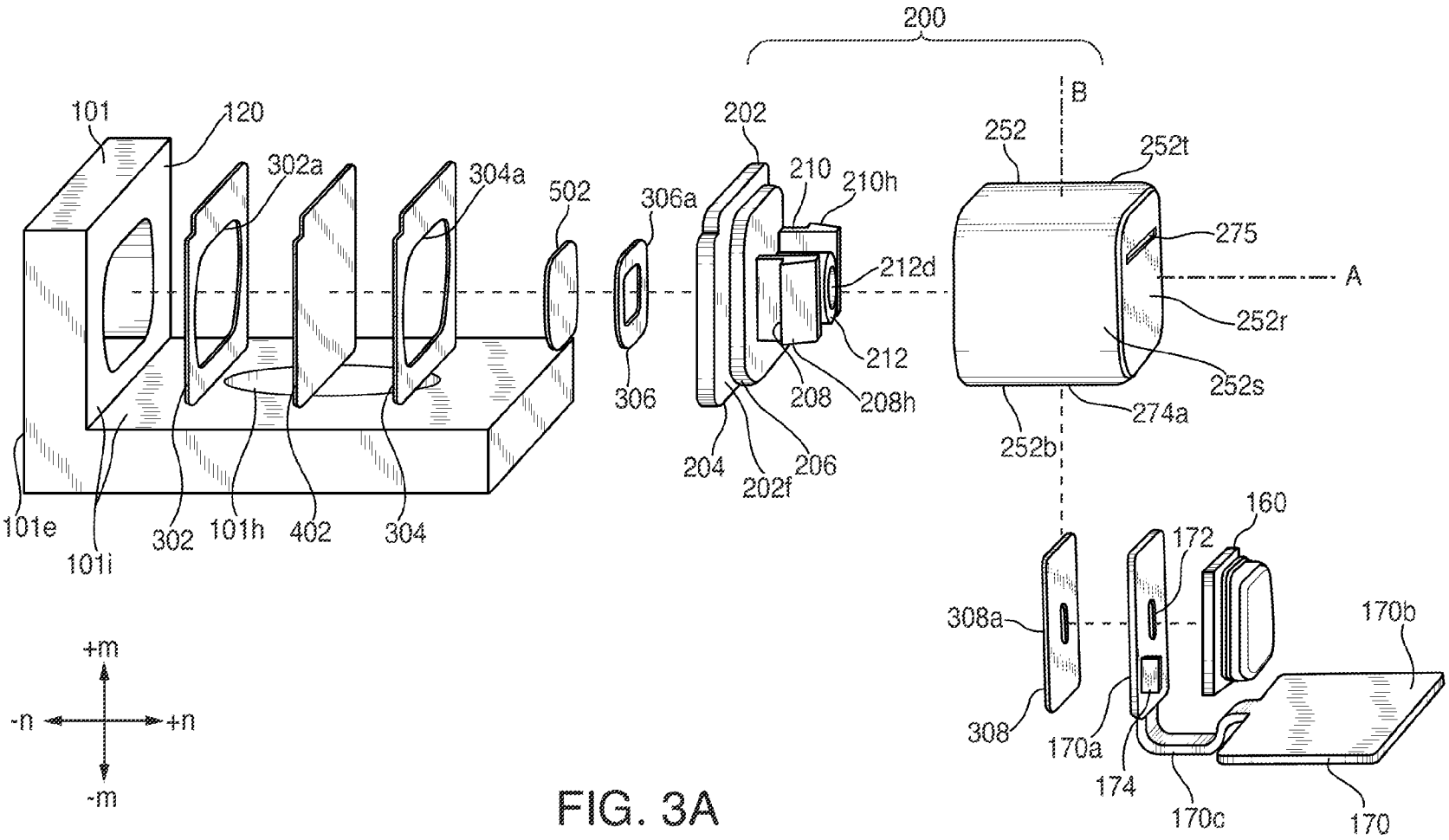
FIG. 3A shows an exploded view of the portion of the electronic device of FIG. 1A, including the microphone boot of FIG. 2A, from a first perspective, in accordance with at least one embodiment.
Figure 3B:
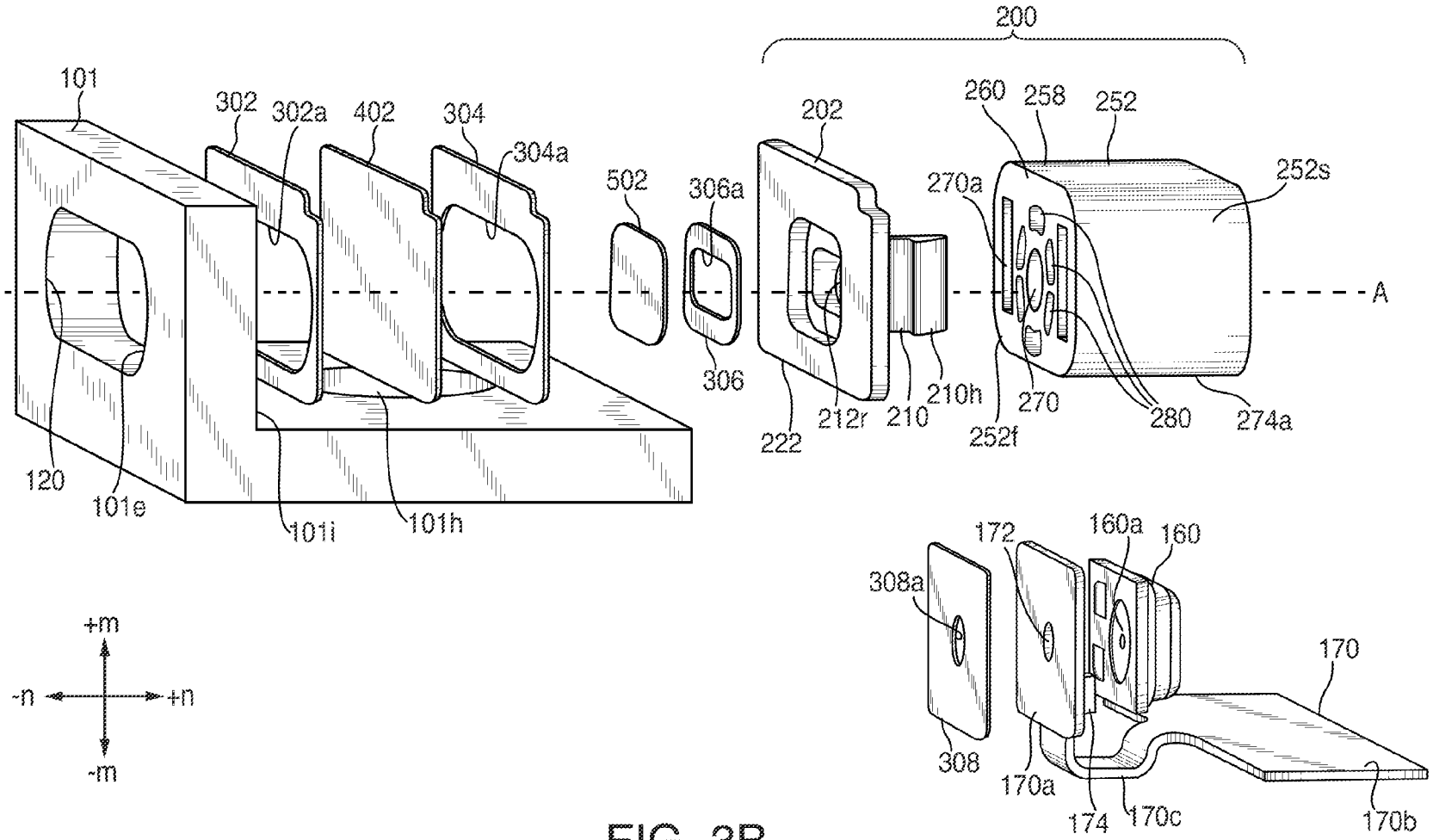
FIG. 3B shows an exploded view of the portion of the electronic device of FIG. 1A, including the microphone boot of FIG. 2A, from a second perspective, in accordance with at least one embodiment.

FIG. 3A shows an exploded view of the portion of electronic device 100, including microphone boot 200, from a first perspective. FIG. 3B shows another exploded view of the portion of electronic device 100, including microphone boot 200, from a second perspective. As shown in FIGS. 3A and 3B, adhesives 302 and 304 may include apertures 302*a* and 304*a*, respectively. Each of apertures 302*a* and 304*a* may be similar in size to housing aperture 120, and may allow sound (e.g., that housing aperture 120 may receive from external surface side 101*e*) to pass to microphone boot 200. Although FIGS. 3A and 3B show cosmetic mesh 402 as solid throughout an entirety of its surface, it should be appreciated that cosmetic mesh 402 may also include one or more holes. These holes may be large enough to pass the received sound, but may also be small enough to block or impede contaminants (e.g., water, dirt, dust, etc.) from traveling into microphone boot 200 (and thus, into microphone 160).

To add an extra layer of protection for microphone 160 (e.g., from external contaminants), an acoustic mesh 502 may also be included. In particular, sound channeling structure 202 may include a recess 222 that may be configured to retain acoustic mesh 502. Acoustic mesh 502 may couple to recess 222 via an adhesive 306, which may also reside on recess 222). Adhesive 306 may be similar to any of adhesives 302 and 304. Although FIGS. 3A and 3B show acoustic mesh 502 as solid throughout an entirety of its surface, it should be appreciated that acoustic mesh 502 may also include one or more holes. These holes may be large enough to pass sound, but may also be small enough to block or impede contaminants (e.g., water, dirt, dust, etc.), which may affect microphone 160's ability to effectively capture sound, from traveling into microphone boot 200 (and thus, into microphone 160).

As shown in FIG. 3A, sound channeling structure 202 may include a frame 204, a platform 206 that may raise from frame 204, a sound tube 212 that may protrude from platform 206, and hooking components 208 and 210. Sound tube 212 may include a hollow channel along its longitudinal length that may extend from a sound receiving aperture 212*r* to a sound delivering aperture 212*d*.

As shown in FIGS. 3A and 3B, sound channeling structure 202 may align with each of adhesive 306, acoustic mesh 502, adhesive 304, cosmetic mesh 402, adhesive 302 and housing aperture 120. In particular, sound channeling structure 202 may align with these components such that substantially all of the sound (e.g., that housing aperture 102 may receive) may pass through aperture 302*a*, cosmetic 402, aperture 304*a*, cosmetic mesh 502, and adhesive 306 (e.g., in this order), and into sound channeling structure 202 via sound receiving aperture 212*r*. The hollow channel of sound tube 212 may deliver the received sound via sound delivering aperture 212*d* with minimal to no leakage.

As shown in FIGS. 3A and 3B, microphone retaining block 252 may include a retaining cavity aperture 274*a*. Retaining cavity aperture 274*a* may lead into a retaining cavity (not shown in FIGS. 3A and 3B) that may be configured to self-center and retain microphone 160 and portion 170*a* of circuit board 170. As described above, microphone 160 may be mounted on portion 170*a*. Thus, retaining cavity aperture 274*a* may have a size large enough to allow the combination of microphone 160 and portion 170*a* to pass therethrough into the retaining cavity. Moreover, the retaining cavity may also be large to accommodate the combination of microphone 160 and portion 170*a*, but may be small enough to prevent movement of the combination of microphone 160 and portion 170*a* while residing therein. Microphone retaining block 252 may also include an adhesive 308 that may secure portion 170*a* (and thus, microphone 160) to an inner surface of microphone retaining block 252. Adhesive 308 may be similar to any of adhesives 302, 304, and 306, and may include an aperture 308*a* that may allow sound to pass into microphone aperture 160*a*. Moreover, adhesive 308 may also form an air-tight seal between microphone retaining block 252 and microphone 160 when microphone 160 interfaces or contacts a concentrator ring (not shown in FIG. 3A) residing within microphone retaining block 252.

As shown in FIG. 3B, microphone retaining block 252 may also include an aperture 270*a* that may lead into a tunnel 270. Aperture 270*a* may be configured to receive at least a portion of sound tube 212. For example, aperture 270 may be configured to receive at least a portion of sound tube 212 that may extend from sound delivering aperture 212*d* to anywhere between sound delivering aperture 212*d* and sound receiving aperture 212*r*. As shown in FIGS. 3A and 3B, aperture 270*a* may align with sound tube 212, as well as each of adhesive 308, a circuit board aperture 172, and microphone aperture 160*a*. In particular, microphone retaining block 252 may align with these components such that substantially all of the sound (e.g., that sound tube 212 may deliver via sound delivering aperture 212*d*) may pass through aperture 308, circuit board aperture 172 (e.g., in this order), and into microphone aperture 160*a*. In this manner, microphone 160 may capture substantially all of the sound (e.g., received via housing aperture 120 from outside of electronic device 100) with minimal to no leakage.

As described above, microphone retaining block 252 may be composed of material that may be softer than the material of sound channeling structure 202. This may allow portions of sound channeling structure 202, that may insert into corresponding portions of microphone retaining block 252, to snug fit within the corresponding portions. In particular, an outer circumference of sound tube 212 may be slightly larger than each of the circumferences of aperture 270*a* and tunnel 270 such that, when sound tube 210 is inserted into tunnel 270, an outer surface of sound tube 212 may snug fit and apply force (e.g., radially outward forces) onto an inner surface of tunnel 270. In such a snug fit configuration, substantially all of the sound, that may be delivered via sound delivering aperture 212*d* of sound tube 212, may enter microphone retaining block 252 with minimal to no leakage.

Because microphone retaining block 252 may be softer or compliant, the shape or outer dimensions of microphone retaining block 252 may change (e.g., expand) when sound tube 212 is inserted into tunnel 270. Such a change in shape or size of microphone retaining block 252 may affect other components that may reside near microphone retaining block 252 within electronic device 100. To prevent this from occurring, microphone retaining block 252 may include one or more relief cuts 280. Relief cuts 280 may surround aperture 270*a*, and may each extend from front face 252*f* to a predefined distance within microphone retaining block 252. Relief cuts 280 may be configured to provide relief to the structure of microphone retaining block 252 when sound tube 212 is inserted into tunnel 270. For example, when aperture 270*a* (and thus, tunnel 270) expands radially outward due to insertion of sound tube 212, each of relief cuts 280 may absorb the expansion by decreasing in size, thus preventing a potential bowing effect that may distort the overall shape (and size) of microphone retaining block 252. In this manner, even when a larger sound tube 212 may be inserted into a comparatively smaller aperture 270*a* and tunnel 270, the overall outer dimensions of microphone retaining block 252 may remain substantially intact (e.g., without any deviation to its intended dimensions).

A snug fit of sound tube 212 within tunnel 270 (e.g., as described above) may at least partially secure sound channeling structure 212 to microphone retaining block 252. However, in some embodiments, microphone retaining block 252 may further secure to sound channeling structure 212 via one or more dedicated securing features. In particular, microphone retaining block 252 may include slots 258 and 260 that may be configured to receive hooking components 208 and 210, respectively. Although not shown in FIGS. 3A and 3B, each of slots 258 and 260 may include a support edge/surface onto which a corresponding hook end 208*h* and hook end 210*h* may rest, or otherwise latch onto. For example, when each of hooking components 208 and 210 are inserted into corresponding slots 258 and 260, hook end 208*h* and hook end 210*h* may each latch or lock onto the corresponding support edge/surface. In this manner, sound channeling structure 202 may securely couple to microphone retaining block 252. It should be appreciated that any of a length of the hooking component, a distance of the support edge from an opening of the slot, and a length of sound tube 212 may be defined such that, when sound tube 212 is inserted into tunnel 270 and when hooking components 208 and 210 are inserted and locked into corresponding slots 258 and 260, a front face 202*f* of sound channeling structure 202 may be substantially flush with front face 252*f* of microphone retaining block 252. For example, the dimensions of the aforementioned components may be defined such that sound channeling structure 202 may form a tight seal with microphone retaining block 252 via front faces 202*f* and 252*f*. In this manner, microphone retaining block 252 may secure to housing 101 (e.g., via sound channeling structure 202) to protect microphone 160 from movement within electronic device 100. Moreover, substantially all of the sound, that may enter electronic device 100 via housing aperture 120, may be channeled by microphone boot 200 directly to microphone 160 with minimal to no leakage.

In some embodiments, an additional structure (not shown) may be included to further secure microphone boot 200 to housing 101. For example, the additional structure may be configured to apply a bias force in the –n direction onto one or more portions of rear surface 252*r* of microphone retaining block 252.

In some embodiments, sound channeling structure 202 may be detachable from microphone retaining block 252. For example, each of hook ends 208*h* and 210*h* may be released from the corresponding support edge of the corresponding slots 258 and 260. In these embodiments, microphone retaining block 252 may include a slit 275 that may allow insertion of one or more tools therein. For example, a tool may be inserted into slit 275 to move one or more of hook ends 208*h* and 210*h* into release positions (e.g., where hook ends 208*h* and 210*h* are released from the corresponding support edges of slots 258*h* and 260*h*). In these release positions, sound channeling structure 202 may be detachable from microphone retaining block 252 (e.g., by applying one or more appropriate forces to any of sound channeling structure 202 and microphone retaining block 252).

Figure 3C:
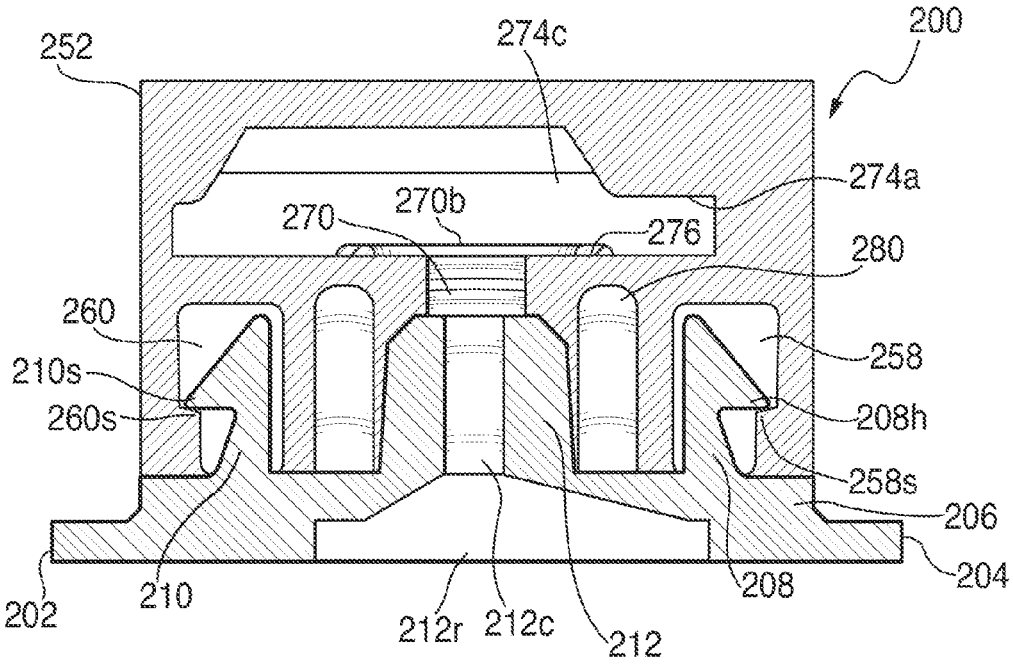
FIG. 3C shows a cross-sectional view of the microphone boot of FIG. 2A, taken in a –m direction of FIG. 2B on a plane formed by the lines W and V of FIG. 2B, in accordance with at least one embodiment.

FIG. 3C shows a cross-sectional view of microphone boot 200, taken in a –m direction of FIG. 2B on a plane formed by the lines W and V of FIG. 2B. As shown in FIG. 3C, sound channeling structure 202 may couple with microphone retaining block 252 to form microphone boot 200. Sound tube 212 may reside within tunnel 270, hooking component 208 may reside within slot 258, and hooking component 210 may reside within slot 260. Each of slots 258 and 260 may include corresponding support surfaces 258*s* and 260*s* that may allow hook ends 258*h* and 260*h* to lock or latch thereon.

Figure 4A:
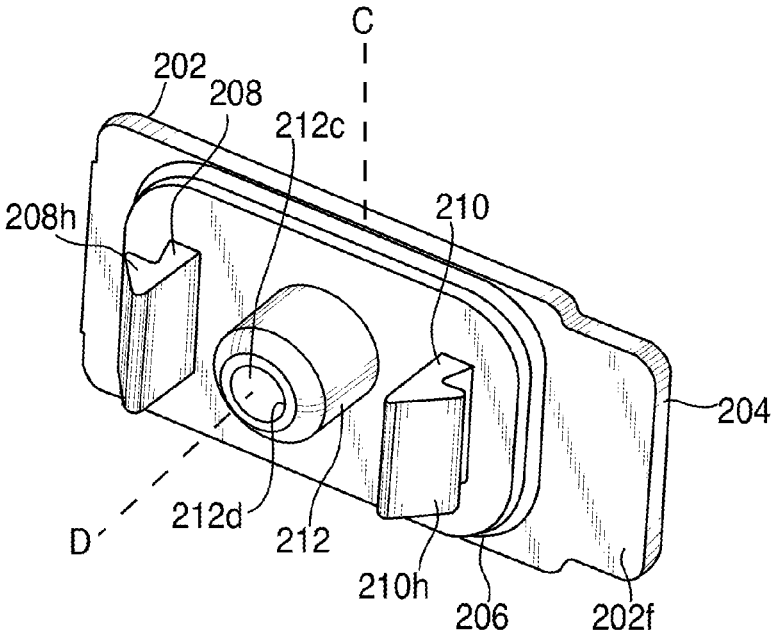
FIG. 4A shows a perspective view of a sound channeling structure of the microphone boot of FIG. 2A, in accordance with at least one embodiment.
Figure 4B:
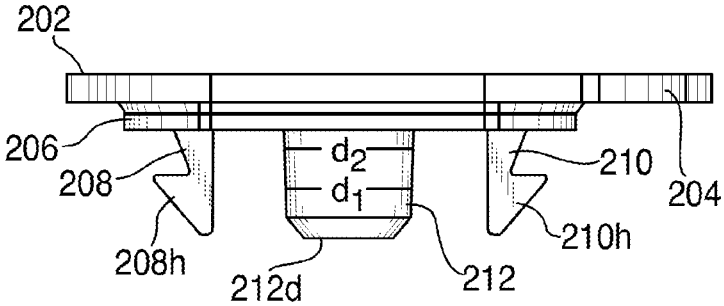
FIG. 4B shows a top view of the sound channeling structure of FIG. 4A, taken along a line C of FIG. 4A, in accordance with at least one embodiment.
Figure 4C:
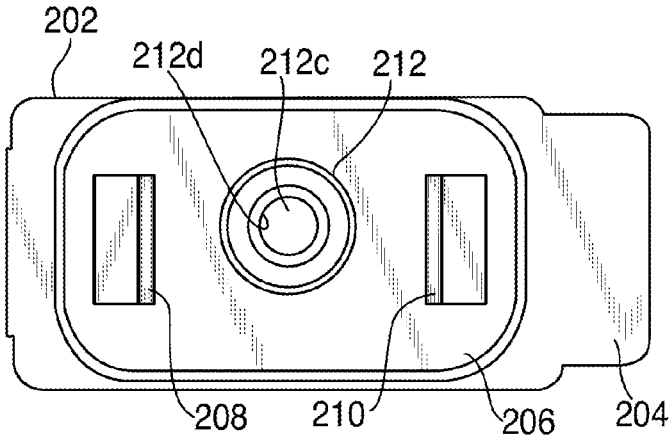
FIG. 4C shows a front view of the sound channeling structure of FIG. 4A, taken along a line D of FIG. 4A, in accordance with at least one embodiment.

FIG. 4A shows a perspective view of sound channeling structure 202. FIG. 4B shows a top view of sound channeling structure 202, taken along a line C of FIG. 4A. FIG. 4C shows a front view of sound channeling structure 202, taken along a line D of FIG. 4A. As shown in FIGS. 4A-4C, sound channeling structure 202 may include sound tube 212 that may protrude from raised platform 206 in a direction facing away from front face 202*f*. Each of hooking components 208 and 210 may also protrude from raised platform 206 in a similar manner. Although FIGS. 4A-4C show sound channeling structure 202 including raised platform 206, in some embodiments, one or more of sound tube 212 and hooking components 208 and 210 may instead protrude directly from frame 204.

As described above with respect to FIGS. 3A and 3B, the outer circumference of sound tube 212 may be at least slightly larger than circumferences of aperture 270*a* and tunnel 270 of microphone retaining block 252. In this configuration, sound tube 212 may snug fit into tunnel 270, which may at least partially expand tunnel 270 into relief cuts 280. As part of this configuration, sound tube 212 may have a first diameter d1 near sound delivering aperture 212*d*, and may have a second larger diameter d2 near raised platform 206 such that (e.g., forming a convex shape), when sound tube 212 is inserted into tunnel 270, a larger diameter portion of sound tube 212 may snug fit within aperture 270*a* of tunnel 270.

Figure 5A:
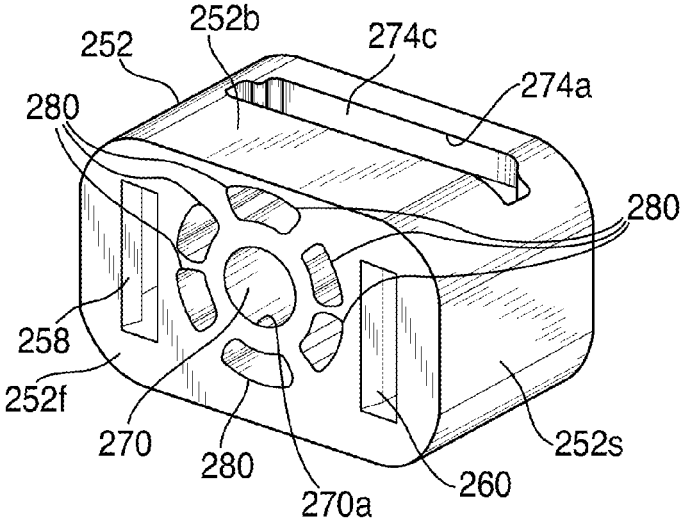
FIG. 5A shows a perspective view of a microphone retaining block of the microphone boot of FIG. 2A, in accordance with at least one embodiment.
Figure 5B:
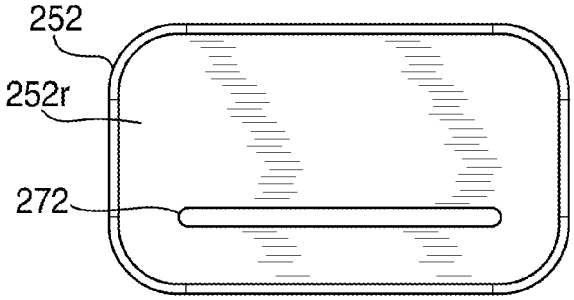
FIG. 5B shows a view of a rear face of the microphone retaining block of FIG. 5A, in accordance with at least one embodiment.
Figure 5C:
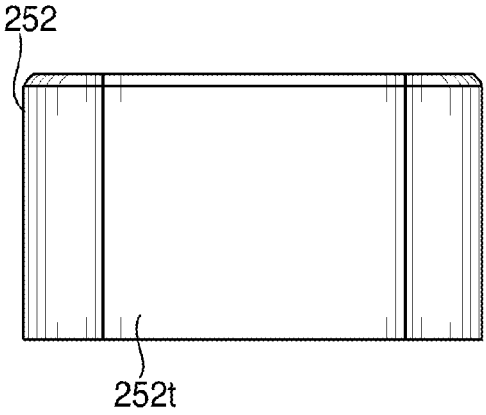
FIG. 5C shows a view of a top face of the microphone retaining block of FIG. 5A, in accordance with at least one embodiment.
Figure 5D:
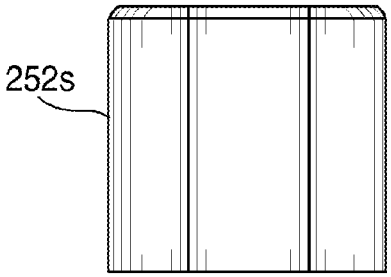
FIG. 5D shows a view of a side face of the microphone retaining block of FIG. 5A, in accordance with at least one embodiment.

FIG. 5A shows a perspective view of microphone retaining block 252. FIG. 5B shows a view of a rear face 252*r* of microphone retaining block 252. FIG. 5C shows a view of a top face 252*t* of microphone retaining block 252. FIG. 5D shows a view of a side face 252*s* of microphone retaining block 252. As shown in FIG. 5A, microphone retaining block 252 may include retaining cavity aperture 274*a* that may reside on bottom face 252*b* of microphone retaining block 252, and that may lead into retaining cavity 274*c*. As shown in FIG. 5B, microphone retaining block 252 may also include slit 275. Although slit 275 may be shown to have a thickness t, it should be appreciated that slit 275 may include any suitable thickness that may allow one or more tools to be inserted therethrough.

Figure 5E:
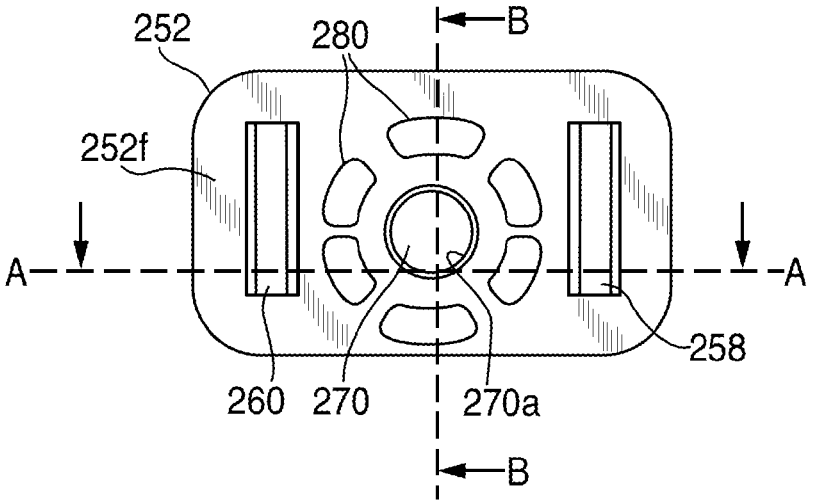
FIG. 5E shows a view of a front face of the microphone retaining block of FIG. 5A, in accordance with at least one embodiment.
Figure 5F:
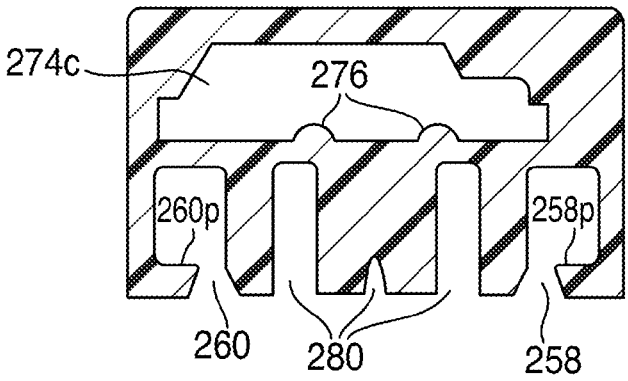
FIG. 5F shows a cross-sectional view of the microphone retaining block of FIG. 5A, taken from line A-A of FIG. 5E, in accordance with at least one embodiment.
Figure 5G:
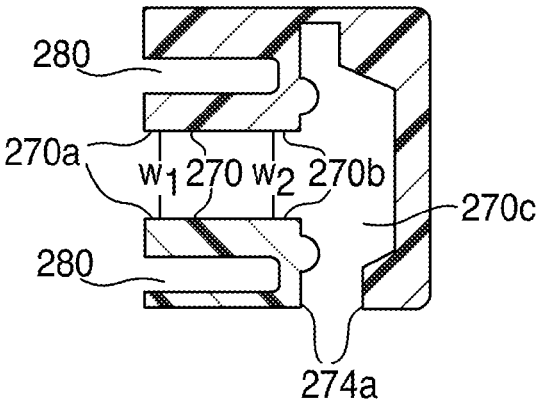
FIG. 5G shows a cross-sectional view of the microphone retaining block of FIG. 5A, taken from line B-B of FIG. 5E, in accordance with at least one embodiment.

FIG. 5E shows a view of front face 252*f* of microphone retaining block 252. FIG. 5F shows a cross-sectional view of microphone retaining block 252, taken from line A-A of FIG. 5E. FIG. 5G shows a cross-sectional view of microphone retaining block 252, taken from line B-B of FIG. 5E. As shown in FIGS. 5F and 5G, retaining cavity 274*c* may be shaped to retain microphone 160 and portion 170*a* of circuit board 170. Further, tunnel 270 may extend from aperture 270*a* to an internal aperture 270*b* that may lead into retaining cavity 274*c*. Retaining cavity 274*c* may also include concentrator ring 276 (e.g., shown as portions of concentrator ring 276 in FIGS. 5F and 5G) that may surround a perimeter of internal aperture 270*b*. Protrusions 276 may be composed of any suitable type of material (e.g., foam), and may be configured to impinge (e.g., at any suitable force) onto various portions of portion 170*a* of circuit board 170 (e.g., when microphone 160 and portion 170*a* are residing within retaining cavity 274*c*). In this manner, retaining cavity 274*c* may secure microphone 160 within retaining cavity 274*c*, which may prevent microphone 160 from falling out of retaining cavity aperture 274*a*.

As described above with respect to FIGS. 4A-4C, the outer circumference of sound tube 212 may be slightly larger than the circumferences of aperture 270*a* and tunnel 270 of microphone retaining block 212. In this configuration, sound tube 212 may snug fit into tunnel 270, which may at least partially expand tunnel 270 into relief cuts 280. As part of this configuration, tunnel 270 may have a diameter d3 near aperture 270*a*, and may have a second smaller diameter d4 near internal aperture 270*b* (e.g., forming a convex shape) such that, when sound tube 212 is inserted into tunnel 270, the portion of sound tube 212 having diameter d1 may reside within the portion of tunnel 270 having diameter w4, and the portion of sound tube 212 having diameter d2 may reside within the portion of tunnel 270 having diameter d3.

Figure 6A:
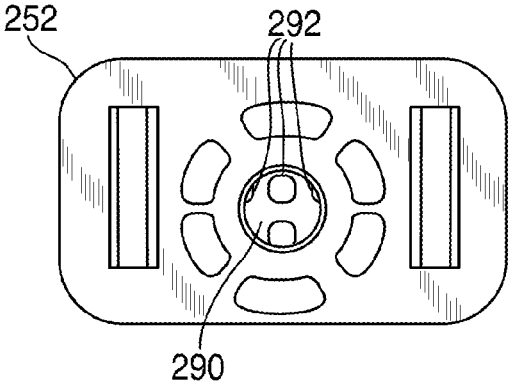
FIG. 6A shows a front view of the microphone retaining block of FIG. 5A, similar to the view shown in FIG. 5E, including an additional rear-impinging structure, in accordance with at least one embodiment.
Figure 6B:
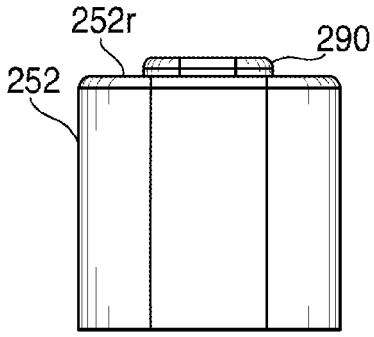
FIG. 6B shows a rear view of the microphone retaining block of FIG. 5A, similar to the view shown in FIG. 5B, including the additional rear-impinging structure of FIG. 6A, in accordance with at least one embodiment.
Figure 6C:
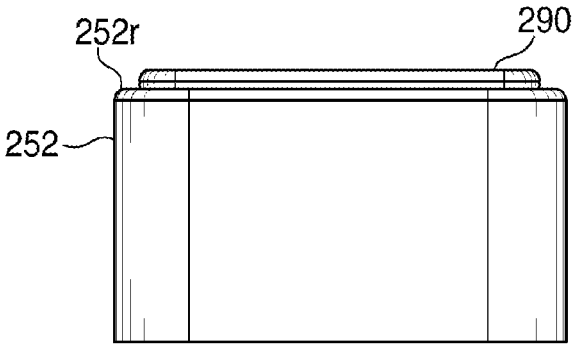
FIG. 6C shows a view of a top face of the microphone retaining block of FIG. 5A, similar to the view shown in FIG. 5C, including the additional rear-impinging structure of FIG. 6A, in accordance with at least one embodiment.
Figure 6D:
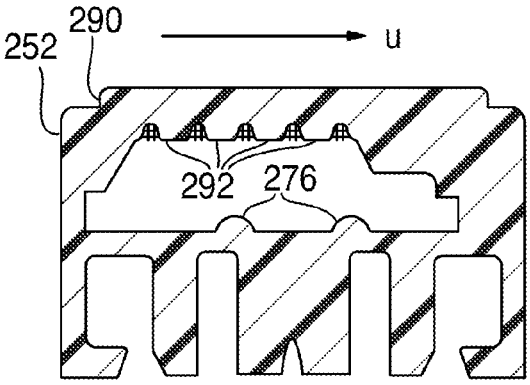
FIG. 6D shows a cross-sectional view of the microphone retaining block of FIG. 5A, similar to the view shown in FIG. 5F, including the additional rear-impinging structure of FIG. 6A, in accordance with at least one embodiment.
Figure 6E:
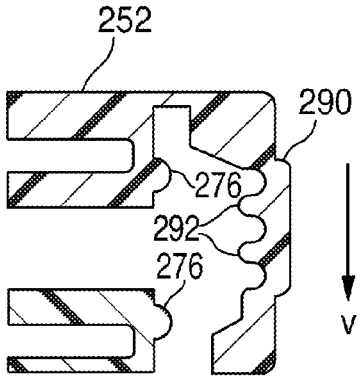
FIG. 6E shows a cross-sectional view of the microphone retaining block of FIG. 5A, similar to the view shown in FIG. 5G, including the additional rear-impinging structure of FIG. 6A, in accordance with at least one embodiment.

In some embodiments, microphone retaining block 252 may also include a rear-impinging structure that may be configured to further secure microphone 160 within retaining cavity 274*c*. FIG. 6A shows a front view of microphone retaining block 252, similar to the view shown in FIG. 5E, including rear-impinging structure 290. FIG. 6B shows a rear view of microphone retaining block 252, similar to the view shown in FIG. 5B, including rear-impinging structure 290. FIG. 6C shows a view of a top face of microphone retaining block 252, similar to the view shown in FIG. 5C, including rear-impinging structure 290. FIG. 6D shows a cross-sectional view of microphone retaining block 252, similar to the view shown in FIG. 5F, including rear-impinging structure 290. FIG. 6E shows a cross-sectional view of microphone retaining block 252, similar to the view shown in FIG. 5G, including rear-impinging structure 290. As shown in FIGS. 6A-6E, microphone retaining block 252 may include rear-impinging structure 290 that may be inserted into an opening (not shown) of rear face 252*r* of microphone retaining block 252.

Rear-impinging structure 290 may include a plurality of protrusions 292 that may span throughout a rear end of retaining cavity 274*c* when rear-impinging structure 290 is inserted into microphone retaining block 252. Protrusions 292 may be composed of any suitable type of material (e.g., foam, the same material as microphone retaining block 252, etc.). In some embodiments, protrusions 292 may be formed during manufacture of microphone retaining block 252 (e.g., at the time of molding of microphone retaining block 252). Each one of protrusions 292 may have a shape and/or composition that may allow it expand into surrounding empty space. In this manner, protrusions 292 may apply a load or force to microphone 160 toward concentrator ring 276 without deforming or changing the outer shape of microphone retaining block 252. Protrusions 292 may, additionally or alternatively, be present on an outer surface of the microphone retaining block 252, and may similarly apply a load or force to microphone 160 toward concentrator ring 276.

Figure 7:
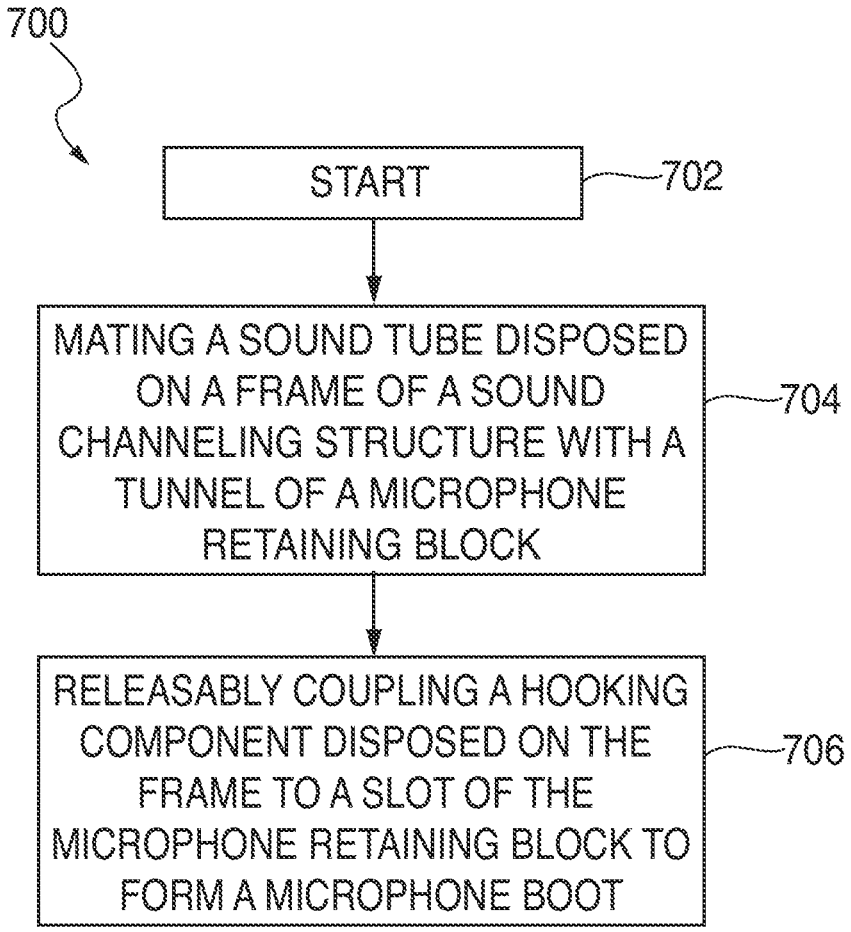
FIG. 7 shows an illustrative process 700 of integrating the sound channeling structure of FIG. 4A with the microphone retaining block of FIG. 5A to form the microphone boot of FIG. 2A.

FIG. 7 shows an illustrative process 700 of integrating sound channeling structure 202 with microphone retaining block 252 to form microphone boot 200. Sound channeling structure 202 may include frame 204 having sound tube 212 and hooking component 208 disposed thereon. Microphone retaining block 252 may include tunnel 270 and slot 258. Process 700 may begin at step 702. At step 704, the process may include mating the sound tube with the tunnel. For example, the process may include mating sound tube 212 with tunnel 270. In particular, the process may include aligning sound tube 212 with tunnel 270, or more specifically, aligning sound delivering aperture 212*d* with aperture 270*a*. The process may also include inserting sound tube 212 into tunnel 270. For example, the process may include moving sound channeling structure 202 in the +n direction of FIG. 3 and/or moving microphone retaining block 252 in the −n direction of FIG. 3 to insert sound tube 212 into tunnel 270.

At step 706, the process may include releasably coupling the hooking component to the slot to form the microphone boot. For example, the process may include releasably coupling hooking component 208 to slot 258 to form microphone boot 200 (e.g., as shown in FIGS. 2A and 2B). In particular, the process may include aligning hooking component 208 (and hook end 208*h*) with an opening of slot 258. The process may also include inserting hooking component 208 (and hook end 208*h*) through the opening and into slot 258. The process may further include hooking or latching hook end 208*h* onto support surface 258*s* within slot 258.

In some embodiments, the process may also include retaining a microphone within a retaining cavity of the microphone retaining block. For example, the process may include retaining microphone 160 within retaining cavity 274*c* of microphone retaining block 252. In some embodiments, step 704 may result in alignment between the sound tube to a microphone aperture of the microphone. For example, step 704 may result in alignment between sound tube 212 to microphone aperture 160*a* of microphone 160. This may allow sound to be delivered from the sound tube 212 (e.g., via sound delivering aperture 212*d*) to microphone 160.

Moreover, in some embodiments, step 706 may result in the securing of the sound channeling structure to the microphone retaining block. For example, step 706 may result in the securing of sound channeling structure 202 to microphone retaining block 252. In this manner, microphone 160, which may reside within microphone retaining block 252, may be fixed in position within microphone boot 200.

It should be appreciated that, although process 700 has been described to include coupling only one hooking component with one slot, process 700 may also include coupling a second hooking component (e.g., hooking component 210) with a second slot (e.g., slot 260).

It is to be understood that the steps shown in process 700 of FIG. 7 are merely illustrative and that existing steps may be modified or omitted, additional steps may be added, and the order of certain steps may be altered.

While there have been described systems and methods for retaining a microphone using a microphone boot, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms such as "up and "down," "front" and "back," "top" and "bottom," "left" and "right," "length" and "width," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Moreover, an electronic device constructed in accordance with the principles of the invention may be of any suitable three-dimensional shape, including, but not limited to, a sphere, cone, octahedron, or combination thereof.

Therefore, those skilled in the art will appreciate that the invention can be practiced by other than the described embodiments, which are presented for purposes of illustration rather than of limitation.

What is claimed is:

1. A microphone boot comprising:
a sound channeling structure comprising:
a frame,
a sound tube, and
at least one hooking component, the sound tube and the at least one hooking component extending away from a first side of the frame; and
a microphone retaining block comprising:
a front face,
a microphone retaining cavity,
a tunnel extending from the front face to the microphone retaining cavity, and
at least one slot,
wherein the tunnel is operative to receive the sound tube and each slot of the at least one slot is operative to releasably couple a respective one of the at least one hooking component when the sound channeling structure is coupled to the microphone retaining block.

2. The microphone boot of claim 1, wherein the first side of the frame is flush with the front face of the microphone retaining block when the sound channeling structure is coupled to the microphone retaining block.

3. The microphone boot of claim 1, wherein the frame comprises a sound receiving aperture on a second side of the frame, the sound receiving aperture integrally formed with the sound tube.

4. The microphone boot of claim 1, wherein the sound tube comprises a sound delivering aperture at one end.

5. The microphone boot of claim 4, wherein the sound delivering aperture faces the microphone retaining cavity when the sound channeling structure is coupled to the microphone retaining block.

6. The microphone boot of claim 1, wherein the at least one hooking component comprises two hooking components.

7. The microphone boot of claim 6, wherein the sound tube is disposed between the two hooking components.

8. The microphone boot of claim 1, wherein the microphone retaining block comprises a retaining cavity aperture in a bottom face of the microphone retaining block, the retaining cavity aperture leading into the microphone retaining cavity.

9. The microphone boot of claim 1, wherein the microphone retaining block comprises a plurality of relief cuts on the front face.

10. The microphone boot of claim 9, wherein the plurality of relief cuts are disposed around the tunnel.

11. The microphone boot of claim 9, wherein the plurality of relief cuts are operative to change in at least one of shape and size when the sound channeling structure is coupled to the microphone retaining block.

12. The microphone boot of claim 9, wherein the plurality of relief cuts are operative to flex in response to entry of the sound tube into the tunnel so that an outer dimension of the microphone boot does not change as a result of the coupling between the sound channeling structure and microphone boot.

13. The microphone boot of claim 1, wherein the at least one slot comprises two slots.

14. The microphone boot of claim 13, wherein the tunnel is disposed between the two slots.

15. An electronic device comprising:

a housing having a housing aperture;

a microphone having a microphone aperture; and a microphone boot having a first boot structure and a second boot structure releasably coupled to each other, the first boot structure comprising:

a sound delivering channel having an opening at each end, a first one of the openings being aligned with the housing aperture and a second one of the openings being disposed in a tunnel formed in the second boot structure, wherein the microphone resides within the second boot structure, and wherein the microphone aperture is aligned with the second one of the openings.

16. The electronic device of claim 15 further comprising a circuit board, wherein the microphone is mounted on a portion of the circuit board.

17. The electronic device of claim 16, wherein the portion of the circuit board resides within the second boot structure.

18. The electronic device of claim 15 further comprising a plurality of acoustic meshes disposed between the first boot structure and the housing aperture.

19. The electronic device of claim 15 further comprising an acoustic mesh disposed within the second boot structure.

20. A method of integrating a sound channeling structure with a microphone retaining block to form a microphone boot, the sound channeling structure comprising a frame having a sound tube and a hooking component disposed thereon, the microphone retaining block comprising a tunnel and a slot, the method comprising:

mating the sound tube with the tunnel; and releasably coupling the hooking component to the slot to form the microphone boot.

21. The method of claim 20, wherein the mating comprises aligning the sound tube with an opening of the tunnel.

22. The method of claim 21, wherein the mating further comprises inserting the aligned sound tube through the opening and into the tunnel.

23. The method of claim 20, wherein the releasably coupling comprises aligning the hooking component with an opening of the slot.

24. The method of claim 23, wherein the releasably coupling comprises inserting the aligned hooking component through the opening and into the slot.

25. The method of claim 24, wherein the releasably coupling further comprises hooking the hooking component onto a support surface within the slot.

26. The method of claim 20 further comprising retaining a microphone with the microphone retaining block.

* * * * *